United States Patent [19]

Suzuki

[11] Patent Number: 4,501,940

[45] Date of Patent: Feb. 26, 1985

[54] OPPOSED CONTACT SWITCH

[75] Inventor: Masaru Suzuki, Aichi, Japan

[73] Assignee: Kabushiki Kaisha Tokai Rika Denki Seisakusho, Aichi, Japan

[21] Appl. No.: 542,818

[22] Filed: Oct. 17, 1983

[30] Foreign Application Priority Data

Oct. 18, 1982 [JP] Japan ..... 57-157718[U]

[51] Int. Cl.[3] ..... H01H 15/00

[52] U.S. Cl. ..... 200/16 A; 200/16 B; 200/242

[58] Field of Search ..... 200/16 R, 16 A, 16 B, 200/16 C, 16 E, 16 F, 237, 238, 239, 240, 241, 242, 243, 244, 245, 246, 247, 248, 249, 250, 251, 252, 253, 254, 255, 256, 257, 258, 259, 260, 261

[56] References Cited

U.S. PATENT DOCUMENTS

| | | | |
|---|---|---|---|
| 2,583,139 | 1/1952 | Ellis | 200/16 A X |
| 3,099,734 | 7/1963 | Scheib, Jr. | 200/241 |
| 3,539,749 | 11/1970 | MacPheat | 200/242 X |
| 3,586,810 | 6/1971 | Brown | 200/159 R |
| 3,624,332 | 11/1971 | Van Benschoten et al. | 200/241 X |
| 4,053,726 | 10/1977 | Schaad | 200/159 R |

FOREIGN PATENT DOCUMENTS

| | | |
|---|---|---|
| 40-4433 | 2/1965 | Japan . |
| 41-12521 | 6/1966 | Japan . |
| 56-11698 | 3/1981 | Japan . |

*Primary Examiner*—A. D. Pellinen
*Assistant Examiner*—Morris Ginsburg
*Attorney, Agent, or Firm*—Sughrue, Mion, Zinn, Macpeak & Seas

[57] ABSTRACT

An opposed contact switch comprising two stationary contacts 8, a movable contact 13 that can bridge the stationary contacts when moved vertically into contact, a spring 15 normally holding the contacts together, a control rod 10 movable vertically, and a contact holder 11 connected to said control rod with oblique guide grooves 12 in the side thereof into which are fitted knobs 14 on the side of the movable contact, whereby the movable contact slides laterally for a short distance across the stationary contact before breaking contact.

2 Claims, 5 Drawing Figures

OPPOSED CONTACT SWITCH

BACKGROUND OF THE INVENTION

This invention relates generally to an electrical switch and particularly to an opposed contact switch in which a movable contact is brought into contact with stationary contacts.

An opposed contact type switch is advantageous in that the movable contact is moved into and out of engagement with the stationary contacts with less frictional resistance and the points of the contacts are scarcely worn. However, it is disadvantageous in that the contacts are liable to degrade in electrical conduction because oxide films are formed on the contact points. In order to overcome the difficulty, heretofore the contacts have been made of gold-based material or silver-based material. Accordingly, the conventional opposed contact type switch suffers from the drawback that the material cost is high and the manufacturing cost is, as a result, also high.

In addition to the opposed contact type switch, a sliding contact type switch has been alternatively employed. The sliding contact type switch is advantageous in that the contacts can be made of relatively inexpensive copper-based material because the oxide films are removed by the sliding of the movable contact. However, it is still disadvantageous for the following reason. As the movable contact is moved between the stationary contact from the start of contact until the movable contact reaches the final contact position, the force of friction between the movable and stationary contacts is very large. In order to reduce the frictional force, lubricant such as grease is applied between the two contacts. However, in this case, the contacts are liable to suffer degradation in insulating properties because a large quantity of metal powder scraped off the contacts by the friction becomes mixed with the lubricant and the lubricant becomes conductive.

SUMMARY OF THE INVENTION

Accordingly, an object of this invention is to provide an opposed contact type switch in which the above-described difficulties that the contacts are liable to conduct unsatisfactorily in the closed position or to become unsatisfactorily insulated in the open position are both eliminated. As a result, employment of inexpensive copper-based material can be satisfactorily used for manufacturing the stationary and movable contacts, which contributes to a reduction of the manufacturing cost of the switch.

These objects are accomplished by an opposed contact switch in which the movable contact slides laterally across the stationary contacts for a short distance before breaking vertical contact or after making vertical contact.

DESCRIPTION OF THE PREFERRED EMBODIMENT

Figure 1:
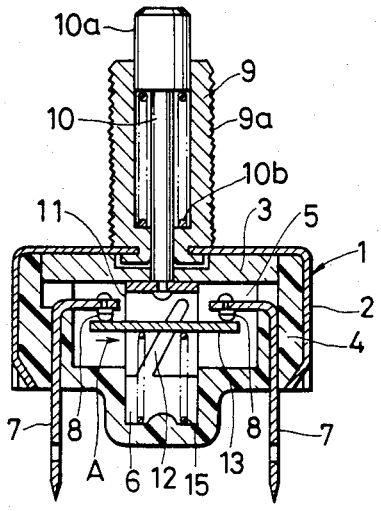
FIG. 1 is a sectional front view of a first embodiment of the opposed contact type switch according to the invention.
Figure 2:
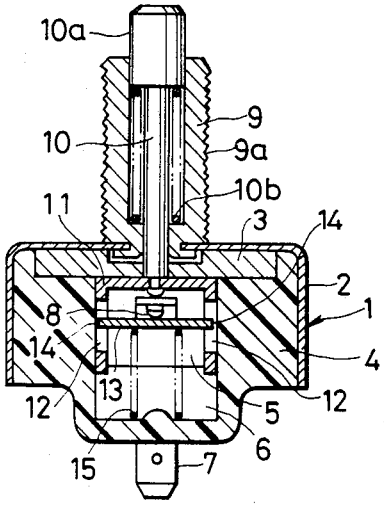
FIG. 2 is a sectional side view of the embodiment of FIG. 1.
Figure 3:
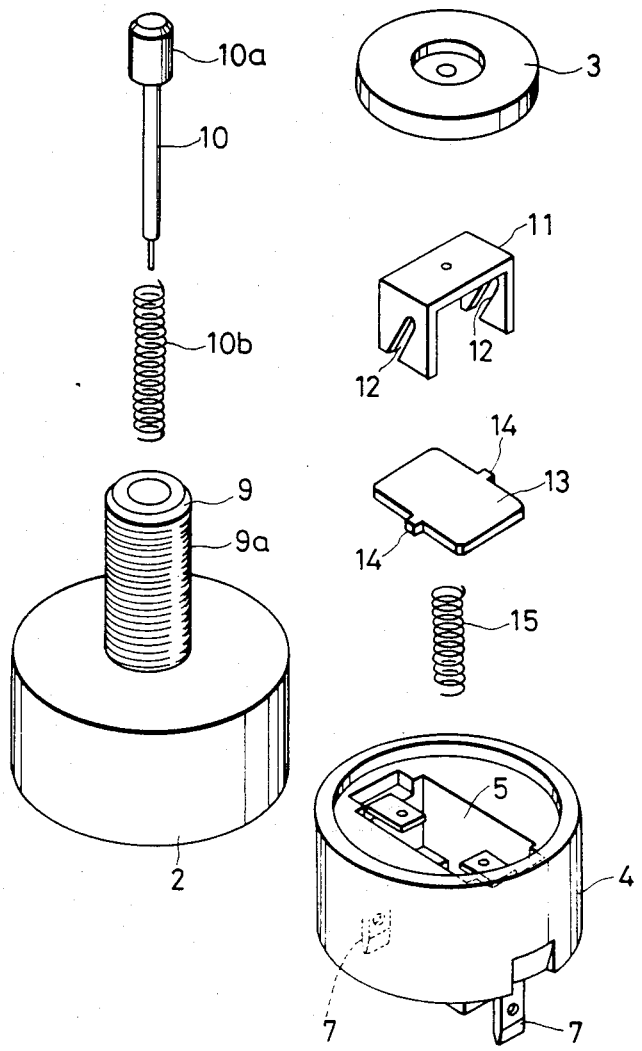
FIG. 3 is an exploded view of the switch.

One embodiment of this invention will be described with reference to the drawings, particularly, in FIGS. 1 and 3, reference numeral 1 designates a switch case which comprises: a cup-shaped external housing 2; an upper wall member 3 mounted on the inner surface at the top of the cup-shaped external housing 2; and a base member 4 mounted on the inner side surface of the external housing 2 and extending around its bottom. A contact accommodating member 5 is provided inside the base member 4, and has a recess 6 cut in the inner surface from the top to the bottom thereof. Further in FIGS. 1 through 3, reference numeral 7 designates two terminals which are arranged in opposite side walls of the base member 4, in such a manner that one end portion of each terminal protrudes laterally from the upper surface of the contact accommodating member 5 and the other end portion is extended through the lower portion of the base member 4. Two stationary contacts 8 and 8 are secured below the upper portion of each of the two terminals 7. An operating rod holder 9 is installed upright on the external housing 2 of the switch case 1. The holder 9 has an external threaded surface **9*a* so that the switch can be easily installed on a given object. An operating rod 10 is movably inserted into the operating rod holder 9. A button 10*a* is secured to one end of the operating rod 10 and protrudes from the outer end of the holder 9. A contact holder 11 is secured to the other end of the operating rod 10, which protrudes into the recess 6 of the contact accommodating member 5. The contact holder 11 is U-shaped, having two opposed walls extending downwardly. The two opposed walls fit between the walls of the recess 6. The two opposed walls of the contact holder 11 have guides 12 and 12 obliquely cut within the walls. It is preferable that the angle of inclination of each guide 12 is 10° to 30° with respect to the axis of the operating rod 10. A spring 10*b* is provided in the operating rod holder 9 so as to return the operating rod 10 to its lifted position. A plate-shaped movable contact 13 made of copper or copper alloy has engaging knobs 14 and 14 extending from the mid-points of two opposed sides thereof. The movable contact 13 is arranged in the contact holder 11 in such a manner that it confronts the stationary contacts 8 and 8 from below when the engaging knobs 14 and 14 are fitted in the guides 12 and 12. The movable contact 13 is urged upwardly by a spring 15 so that it is normally brought into contact with the stationary contacts 8 and 8**.

Figure 4:
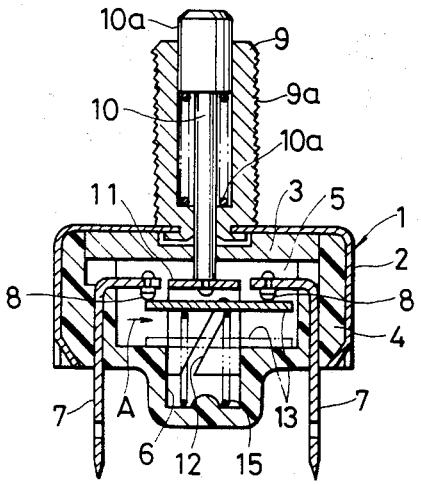
FIG. 4 is a sectional frnt view corresponding to FIG. 1 showing the switch just prior to the open position and (in phantom lines) in the open position.

The operation of the switch thus constructed will now be described. In FIG. 1, the movable contact 13 is in contact with the stationary contacts 8 and 8, so that contacts 8 and 8 are connected and electrically conductive to each other, when the engaging knobs 14 and 14 of the movable contact 13 are positioned substantially at the mid-points of the guides 12 and 12. Under this condition (FIG. 1), as the operating rod 10 is moved downward, the contact holder 11 is also moved downwardly, so that the guides 12 and 12 slide with respect to the engaging knobs 14 and 14 of the movable contact 13. However, the spring 15 applies an upward force to the movable contact 13 so that the movable contact 13 is maintained in contact with the stationary contacts 8 and 8. Therefore, in the initial operation of lowering the control rod 10, the engaging knobs 14 and 14 are not moved downward, but instead the engaging knobs slide in a lateral direction (in the direction of the arrow A, or horizontally). This direction is substantially perpendicular to the opening and closure direction of the movable contact 13 with the stationary contacts 8 (the vertical or axial direction of the operating rod holder 9). Accordingly, the movable contact 13 slides across the stationary contacts 8 and 8. When the engaging knobs 14 and 14 reach the upper ends of the guides 12 and 12 as indicated by the solid lines in FIG. 4, these engaging knobs 14 and 14 push the movable contact 13 downward against the elastic force of the spring 15. As a result, the movable contact 13 is separated apart from the stationary contacts 8 and 8 as indicated by the broken line in FIG. 4. Upon release of the operating rod 10, the above-described operations are carried out in the reverse order. Accordingly, the movable contact 13 slides in the direction opposite to the direction of the arrow A after making contact with the stationary contacts 8 and 8.

In the above-described switch, the movable contact 13 is moved in the axial direction of the operating rod 10 to engage and disengage the stationary contacts 8 and 8. Therefore no frictional resistance is involved in the vertical movement. Furthermore, as the movable contact 13 slides laterally a short distance before disengaging from the stationary contacts 8 and 8 and it further slides after it has engaged the stationary contacts 8 and 8, oxide films which are liable to develop on the stationary contacts 8 and the movable contact 13 are scraped off. Accordingly, these contacts are maintained electrically conductive at all times. Since the opposed connecting point contacts are employed, the sliding region of the movable contact 13 is determined by only a part of the operating region of the operating rod 10. This is the region before the movable contact 13 leaves the stationary contacts 8 upon disengagement and after the movable contact 13 contacts the stationary contacts 8 after reengagement. Accordingly, in this case, the frictional resistance is very low, and conductive metal powder is scarcely created. Therefore, even when the contacts 8 and 13 are coated with lubricant such as grease, they are well-insulated upon disengagement.

Figure 5:
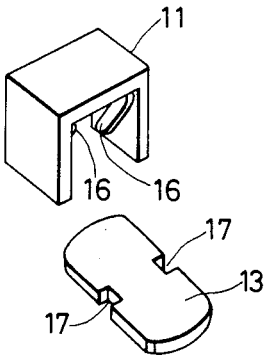
FIG. 5 is a perspective view showing a contact holder and a movable contact in a second embodiment of the invention.

FIG. 5 shows a second embodiment of the invention. The second embodiment is different from the first embodiment in that the contact holder 11 has guides 16 protruding from the two opposed walls, and the movable contact 13 has engaging cuts 17 which are engaged with the guides 16. The effects of the second embodiment are similar to those of the first embodiment.

In the above-described embodiments, the guides are provided on the side of a piece connected to the operating rod, and the engaging knobs or cuts are provided on the side of the movable contact. However, the switch may be so modified that the engaging knobs or cuts are provided on the side of the operating rod 10 and the guides are provided on the side of the movable contact 13. In addition to the stationary contacts 8 and 8 in FIG. 1, two more stationary contacts may be provided on the botton of the base member 4 in such a manner that they confront and contact the aforementioned movable contact 13. In this case, a two-circuit change-over switch can be provided.

As is apparent from the above description, the specific feature of the invention resides in the opposed contact type switch in which the stationary contacts and the movable contact are separated along the axis of the operating rod. The operating rod moves the movable contact along its axis into and out of engagement with the stationary contacts. Oblique guides are provided on the sides of either the operating rod or movable contact, and engaging means are provided on the other side of these which engage with the guides and slides the movable contact in the lateral direction substantially upon the operation of the operating rod. The movable contact is maintained in contact with the stationary contacts during the sliding motion so that the contacts are prevented from developing unsatisfactory conduction and insulation properties. Accordingly, the stationary and movable contacts can be made of inexpensive material such as copper-based material, which contributes greatly to a reduction of the manufacturing cost.

I claim:

1. An opposed contact switch, comprising:

two stationary contacts, a movable contact for contacting and electrically interconnecting said two stationary contacts, first spring biasing means for biasing said movable contact into a first vertical position in contact with said two stationary contacts, said biasing means consisting of a contact spring directly in contact with said movable contact, said movable contact having engaging knobs protruding therefrom, a contact holder having vertically extending sides with guides therein inclined with respect to the vertical, said engaging knobs slidably fitting into said guides, and plunger means for moving said contact holder vertically through a first portion of a stroke to cause said guides and engaging knobs to move said movable contact laterally across, but still in contact with said stationary contacts, and through a second portion of a stroke to cause said movable contact to move vertically away from the first position to a second vertical position out of contact with said stationary contacts, and release of said plunger means results in the opposite sequence of movement of said movable contact.

2. An opposed contact switch, comprising:

two stationary contacts, a movable contact for contacting and electrically interconnecting said two stationary contacts, first spring biasing means for biasing said movable contact into a first vertical position in contact with said two stationary contacts, said biasing means consisting of a contact spring directly in contact with said movable contact, said movable contact having grooves therein, a contact holder having vertically extending sides with protrusions thereon inclined with respect to the vertical, said protrusions slidably fitting into said grooves, and plunger means for moving said contact holder vertically through a first portion of a stroke to cause said grooves and protrusions to move said movable contact laterally across, but still in contact with, said stationary contacts, and through a second portion of a stroke to cause said movable contact to move vertically away from the first position to a second vertical position out of contact with said stationary contacts, and release of said plunger means results in the opposite sequence of movement of said movable contact.

* * * * *